US006033260A

United States Patent [19]

Murata et al.

[11] Patent Number: 6,033,260

[45] Date of Patent: Mar. 7, 2000

[54] SHIELDING-MEMBER-CONTAINING CONNECTOR ASSEMBLY

[75] Inventors: Masaaki Murata; Masaharu Hirota, both of Aichi; Isao Kameyama; Satoru Kaneko, both of Shizuoka, all of Japan

[73] Assignee: Yazaki Corporation, Tokyo, Japan

[21] Appl. No.: 09/017,708

[22] Filed: Feb. 5, 1998

[30] Foreign Application Priority Data

Feb. 5, 1997 [JP] Japan ..... 9-022814

[51] Int. Cl.[7] ..... H01R 9/05

[52] U.S. Cl. ..... 439/578; 439/607

[58] Field of Search ..... 439/607–620, 439/578–85

[56] References Cited

U.S. PATENT DOCUMENTS 5,707,253 1/1998 Matsumoto et al. ..... 439/610

FOREIGN PATENT DOCUMENTS 50-150890 12/1975 Japan .
61-91876 6/1986 Japan .
4-69878 6/1992 Japan .
6-231823 8/1994 Japan .
7-245153 9/1995 Japan .

*Primary Examiner*—Lincoln Donovan
*Attorney, Agent, or Firm*—Sughrue, Mion, Zinn, Macpeak & Seas, PLLC

[57] ABSTRACT

A shielding-member-containing connector assembly (1) includes a female connector (2), and a male connector (3). A groove portion (5) is provided in the inside of a metal shell (4) shield-connected to a shielded electric wire (W) of the female connector (2). The outside of the metal shell (4) is covered with a shrinkable tube (36). The male connector (3) includes a shielding member (6) shield-connected to a shielded electric wire (W), a suitable number of resilient pieces (9) having engagement protrusions (10) extended to the outside of a male housing (8) which holds a male terminal (7), a slide member (11) slidable in an axial direction, the slide member (11) having a pressing wall (13), and a notch portion (12) from which the engagement protrusions (10) are projected is provided in the slide member (11).

11 Claims, 7 Drawing Sheets

SHIELDING-MEMBER-CONTAINING CONNECTOR ASSEMBLY

BACKGROUND OF THE INVENTION

1. Field of the Invention

This invention relates to a shielding-member-containing connector assembly for connecting shielded electric wires used for electrical connection of an audio equipment mounted on a car, or the like.

2. Background

Heretofore, various shielding-member-containing connector assemblies for connecting shielded electric wires are known. For example, a connector assembly 51 shown in FIGS. 7 and 8 is disclosed in Unexamined Japanese Utility Model Publication No. Hei. 4-69878. The connector assembly 51 is designed so that a plug type male connector 52 is fitted and connected to a socket type female connector 53.

A notch portion 55 is provided in the center portion of a male housing 54 of the male connector 52 so that the female connector 53 is connected and locked to the male connector 52 through the notch portion 55. Further, a shielded electric wire W is held in the inside of the rear end portion of the male housing 54. A covering portion of the shielded electric wire W in the male housing 54 is removed so that core wires 56 and shielding braids S are exposed to the outside. As shown in FIG. 8, the shielding braids S are spread correspondingly to the inside form of the male housing 54, for example, of a square section, and a rectangular tube-like shielding braid connection member 57 as a shielding member is soldered to leading ends of the shielding braids S. Incidentally, the shielding braid connection member 57 abuts on the notch portion 55 so that the notch portion 55 is blocked by means of the shielding braid connection member 57 from its inside. Further, the core wires 56 are connected to a male terminal 58 embedded in the forward end portion of the male housing 54.

The female connector 53 has a male terminal 60 connected to the female terminal 58. The male terminal 60 is provided to be erected on a rear end bottom wall portion of a socket type female housing 59. A back terminal 61 is projected from the rear end surface of the bottom wall so that the female connector 53 is connected to an equipment body (not shown) through an electric wire. Two leaf springs 62 are embedded in the female housing 59. Overhanging portions 63 are provided so as to project to the outside of the female housing 59. Leaf spring protrusions 64 are provided in the inside of the female housing 59. Forward end portions of the leaf springs 62 are projected outward from the forward end of the female housing 59, so that portions 65 for introduction of the male housing 54 are formed. Incidentally, a flange portion 66 of the female housing 59 is mounted to a female connector mount hole of a housing which serves also to shield the equipment body. Accordingly, the male terminal 60 is inserted into a shield zone, so that a general electric wire which is not shielded is connected to the back terminal 61.

In the shielding-member-containing connector assembly configured in such a manner as described above, when the female connector 53 is mounted to the mount hole of the equipment body through the flange portion 66, the overhanging portions 63 of the leaf spring 62 are brought into contact with the housing which serves also to shield the equipment body. Accordingly, the leaf springs 62 function as shielding members.

When the male connector 52 is inserted into the female connector 53, the introduction portions 65 and protrusions 64 of the leaf springs 62 are forced to be spread. As a result, the male terminal 60 is inserted and connected into the female terminal 58 and, at the same time, the protrusions 64 of the lead springs 62 are engaged with the notch portion 55 from the outside, so that the male housing 54 is locked. In this occasion, the shielding braid connection member 57 is pressed against the distal ends of the leaf spring protrusions 64 so as to be brought into contact with the distal ends of the leaf spring protrusions 64. Accordingly, the shielding braids S are shielded, so that the shielding-member-containing connector assembly 51 together with the shielded electric wire W are included in the shield zone.

In the conventional shielding-member-containing connector assembly 51, however, the female and male housings 54 and 59 should be disconnected from each other while the two introduction portions 65 of the leaf springs 62 are pulled outward as occasion demands. There arises a problem that efficiency in disconnection of the connectors is poor.

Furthermore, the introductions 65 are exposed to the outside even after the female and male connectors 52 and 53 are fitted and connected to each other. Accordingly, there is a possibility of short-circuiting, so that a problem is left in terms of safety and reliability of the connectors.

SUMMARY OF THE INVENTION

Upon such circumstances, an object of the present invention is to provide a shielding-member-containing connector assembly in which female and male connectors are disconnected easily, and also shielding and electrically conductive members are prevented from being exposed to the outside.

According to a first aspect of the present invention, a connector assembly which comprises: a female connector comprising a female housing including a female terminal to which a shielded electric wire is electrically connected, and a metal shell including a hollow portion receivable the female housing, the hollow portion having a groove portion formed in an inside thereof, the metal shell being shield-connected to the shielded electric wire; and a male connector comprising a male housing including a male terminal to which a shielded electric wire is electrically connected, a shielding member shield-connected to the shielded electric wire, the shielding member including a plurality of resilient pieces which have at least one engagement protrusion, and a slide member provided on an outer circumference of the shielding member, the slide member including a notch portion formed so that the engagement protrusion of the shielding member can be projected and a pressing wall which can press the resilient pieces toward the axial center side, in which when the female connector and the male connector are fitted to each other, the engagement protrusion is engaged with the groove portion. Further, the female housing is received in the metal shell.

In the connector assembly configured as described above, the female and male connectors are covered with the metal shell and the shielding member respectively, and further, the engagement protrusions provided in the resilient pieces are engaged with the groove portion at the time of connection of the connectors. Accordingly, the connectors are locked securely and connected firmly. Further, the slide member is provided on the outer circumference of the shielding member having the engagement protrusions provided thereon so that the slide member is axially slidable. The notch portion is provided in the slide member so that the engagement protrusions can be projected from the notch portion. The wall portion of the slide member in front of the notch portion functions as a pressing wall pressing the engagement protrusions toward the axial center side.

Accordingly, if the female and male connectors are pulled apart from each other to be disconnected from each other, the slide member moves in the connector disconnecting direction and the pressing wall makes the engagement protrusions together with the resilient pieces depart from the groove portion. Accordingly, it is easy to disconnect the connectors, so that efficiency in maintenance can be improved.

Preferably, the outer circumference of the female connector is covered with a shrinkable tube formed of an electrically nonconductive material.

In the shielding-member-containing connector assembly configured as described above, the slide member as the outer circumference of the male connector can be formed of an electrically nonconductive material, and further the metal shell as the outer circumference of the female connector is shaped like a simple tube. Accordingly, the metal shell can be covered with the electrically nonconductive shrinkable tube easily.

Accordingly, even in the case where another electrically conductive material is brought into contact with the outer circumference of the connector assembly, there is no risk of short-circuiting. Safety and reliability of the connector assembly can be improved.

BRIEF DESCRIPTION OF THE DRAWINGS

FIG. 6A shows a state in which a plug terminal is connected to a shielded electric wire, FIG. 6B shows a state in which a slide member is assembled, and FIG. 6C shows a state in which resilient pieces are assembled;

DETAILED DESCRIPTION OF THE PREFERRED EMBODIMENT

An embodiment of the present invention will be described below in detail with reference to FIGS. 1 through 5 and FIGS. 6A–6C.

Figure 1:
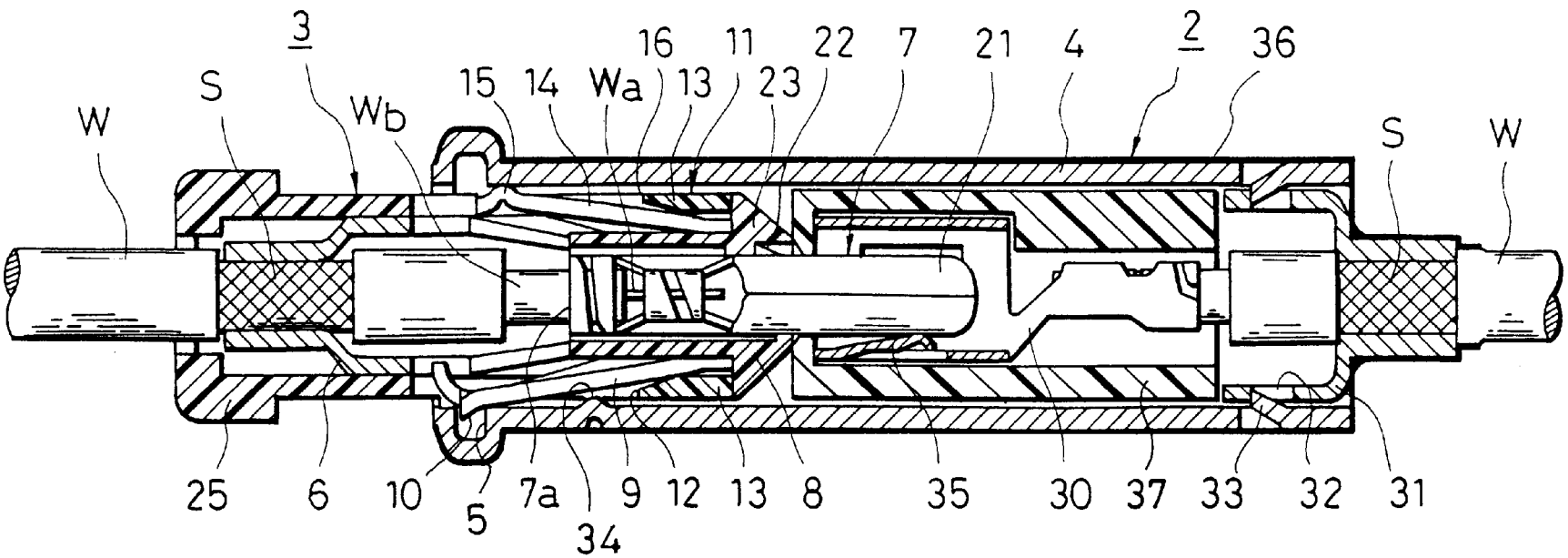
FIG. 1 is a longitudinal sectional view showing an embodiment of the present invention as to a shielding-member-containing connector assembly inclusive of engagement protrusions.
Figure 2:
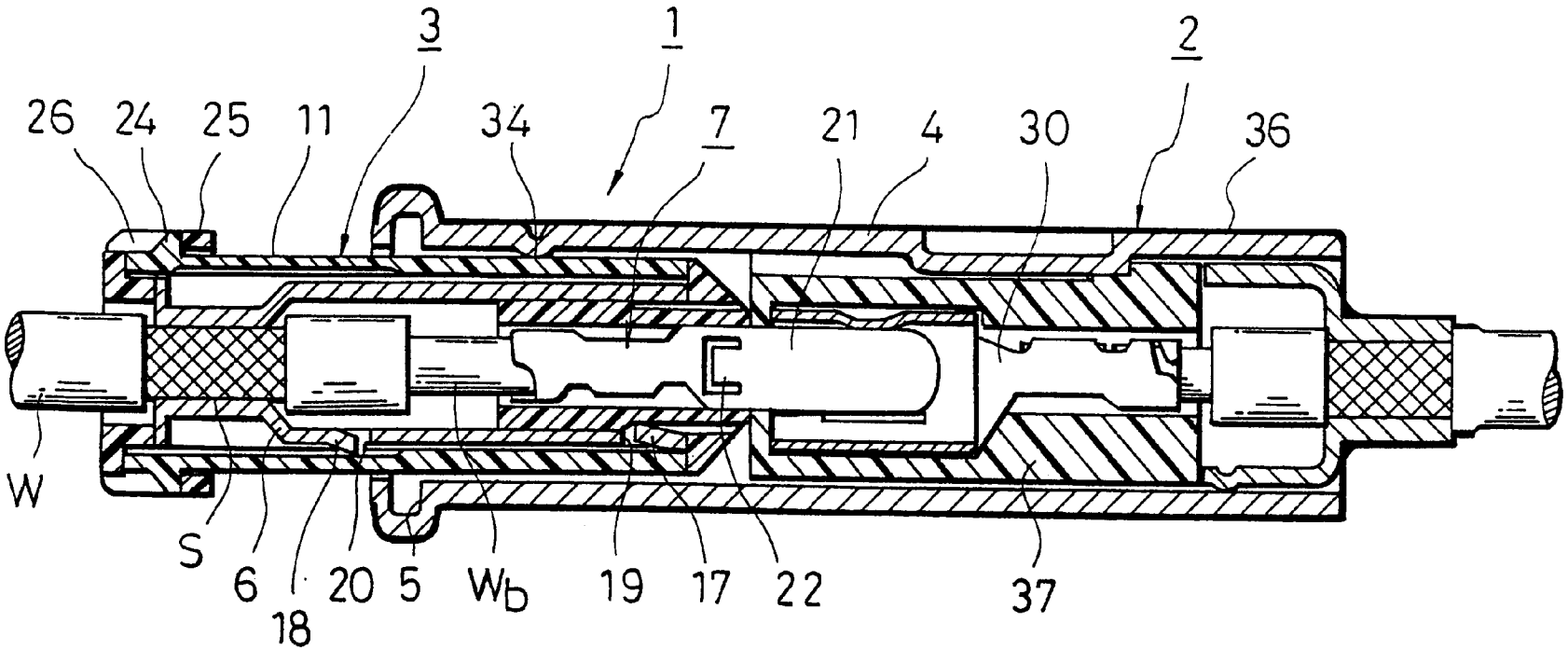
FIG. 2 is a longitudinal sectional view of the connector assembly depicted in FIG. 1.

As shown in FIGS. 1 and 2, a shielding-member-containing connector assembly 1 comprises female and male connectors 2 and 3 connected to shielded electric wires W respectively.

Figure 3:
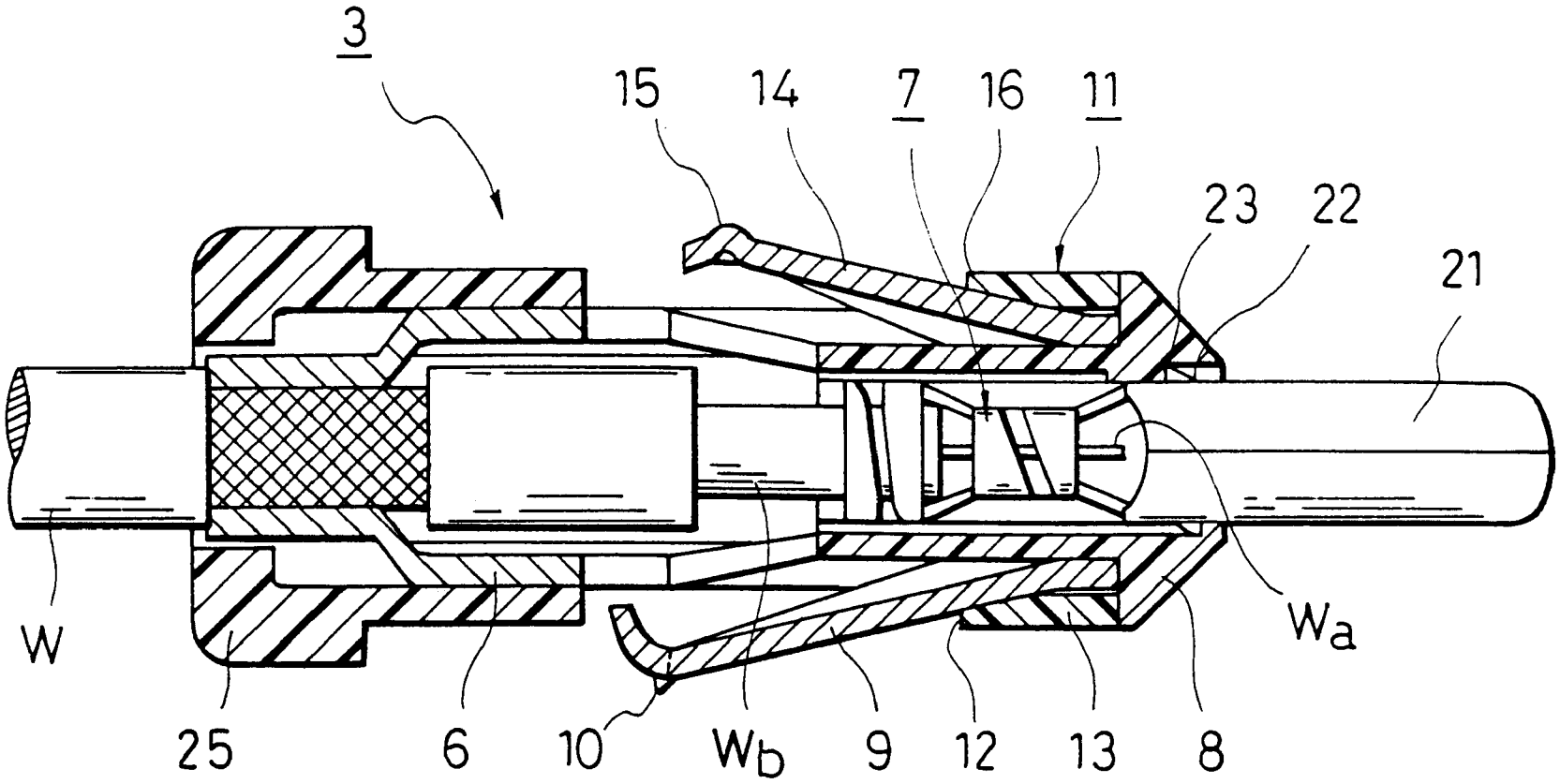
FIG. 3 is a longitudinal sectional view of the male connector depicted in FIG. 1.

As shown in FIG. 3, the male connector 3 includes a shielding braid connection member 6 formed of an electrically conductive material such as a metal, or the like, and a male housing 8, for holding a male terminal 7, formed of an electrically nonconductive material such as a synthetic resin, or the like. The shielding braid connection member 6 serves as a shielding member shield-connected to a shielding braids S for shielding the shielded electric wire W. The shielding braid connection member 6 has a suitable number of resilient pieces 9 formed so as to be extended to the outer circumferential portion of the male housing 8. A suitable number of engagement protrusions 10 are provided in the resilient pieces 9 so as to be engaged with a groove portion 5. A slide member 11 formed of an electrically nonconductive material such as a synthetic resin, or the like, is provided on the outer circumference of the shielding braid connection member 6 so as to be axially slidable. A notch portion 12 is formed in the slide member 11 so that the engagement protrusions 10 can be projected from the notch portion 12. A pressing wall 13 is formed in a wall portion of the slide member 11 in front of the notch portion 12 so that the engagement protrusions 10 can be pressed together with the resilient pieces 9 toward the axial center side by the pressing wall 13.

More in detail, other than the resilient pieces 9 having the engagement protrusions 10, at least one resilient piece 14 is provided in the shielding braids connection member 6. The resilient piece 14 has, at its end, a contact 15 which is brought into contact with the inner wall of a metal shell 4 of the female connector 2 so as to electrically connect therewith. Accordingly, a notch portion 16 is provided in the slide member 11 so that the contact 15 can be projected from the notch portion 16. Further, an inward and obliquely backward lance 17 is provided on a forward end portion of the shielding braid connection member 6 and an outward and obliquely forward lance 18 is provided on an intermediate portion of the shielding braid connection member 6 so that the respective lances 17 and 18 lock a step portion 19 of the outer wall of the male housing 6 and a step portion 20 of the inner wall of the slide member 11, respectively.

Further, an outward and obliquely backward lance 22 is formed on the outer circumference of a plug terminal 21 provided on a forward end portion of the male terminal 7, so that the lance 22 locks a step portion 23 provided in the inner wall of the forward end portion of the male housing 8. Further, lock protrusions 24 are provided in the rear end portion of the slide member 11 so that a rear cap 25 is locked in a lock hole 26. Furthermore, the rear cap 25 is brought into contact with the rear end surface of the slide member 11 and the rear end surface of the shielding braid connection member 6.

Figure 6A:
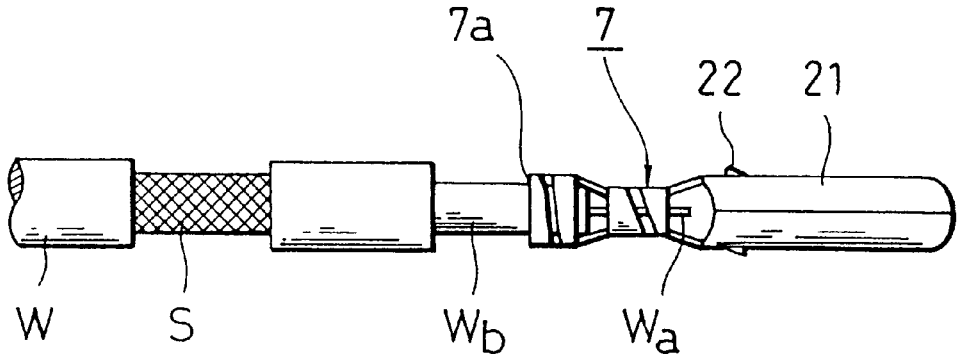
FIGS. 6A to 6C are explanatory views showing a procedure of assembling the male connector depicted in FIG. 1.

The procedure of assembling the male connector 3 is as follows. First, as shown in FIG. 6A, a core wire Wa exposed from the shielded electric wire W is inserted into the male terminal 7 from the rear end surface 7*a*. Then, the core wire Wa and a sheathed core wire Wb containing the core wire Wa are clamped by the male terminal 7. Incidentally, the shielded electric wire W is adjusted into a predetermined length sufficient to expose the core wire Wa, the sheathed core wire Wb and the shielding braids S in advance so that relational positions shown in FIG. 3 are obtained when the male connector 3 is assembled.

Figure 6B:
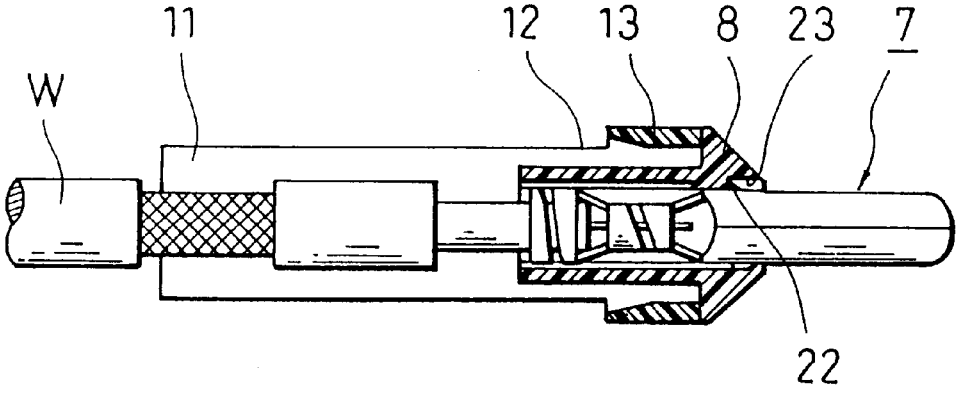

When the male housing 8 is then fitted onto the plug terminal 21 from the front end of the plug terminal 21 as shown in FIG. 6B, the step portion 23 is locked by the lance 22. The slide member 11 is then inserted into the male housing 8 from the rear until the slide member 11 abuts against the front end flange portion of the male housing 8.

Figure 6C:
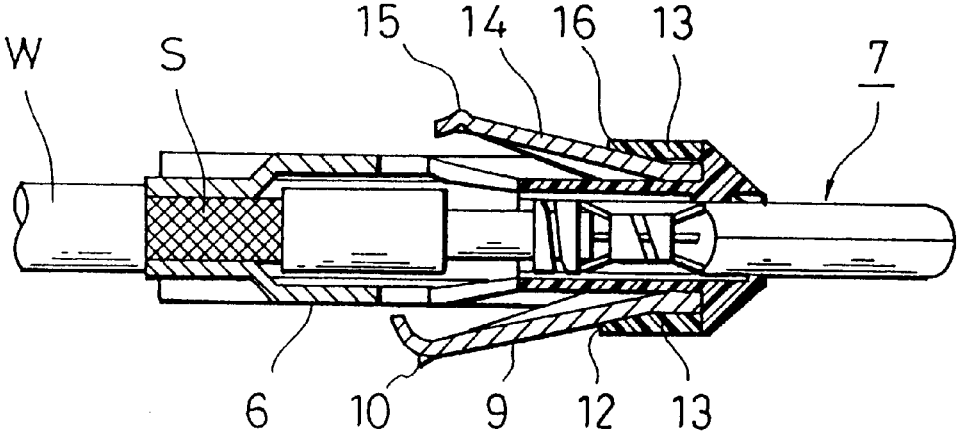
Figure 7:
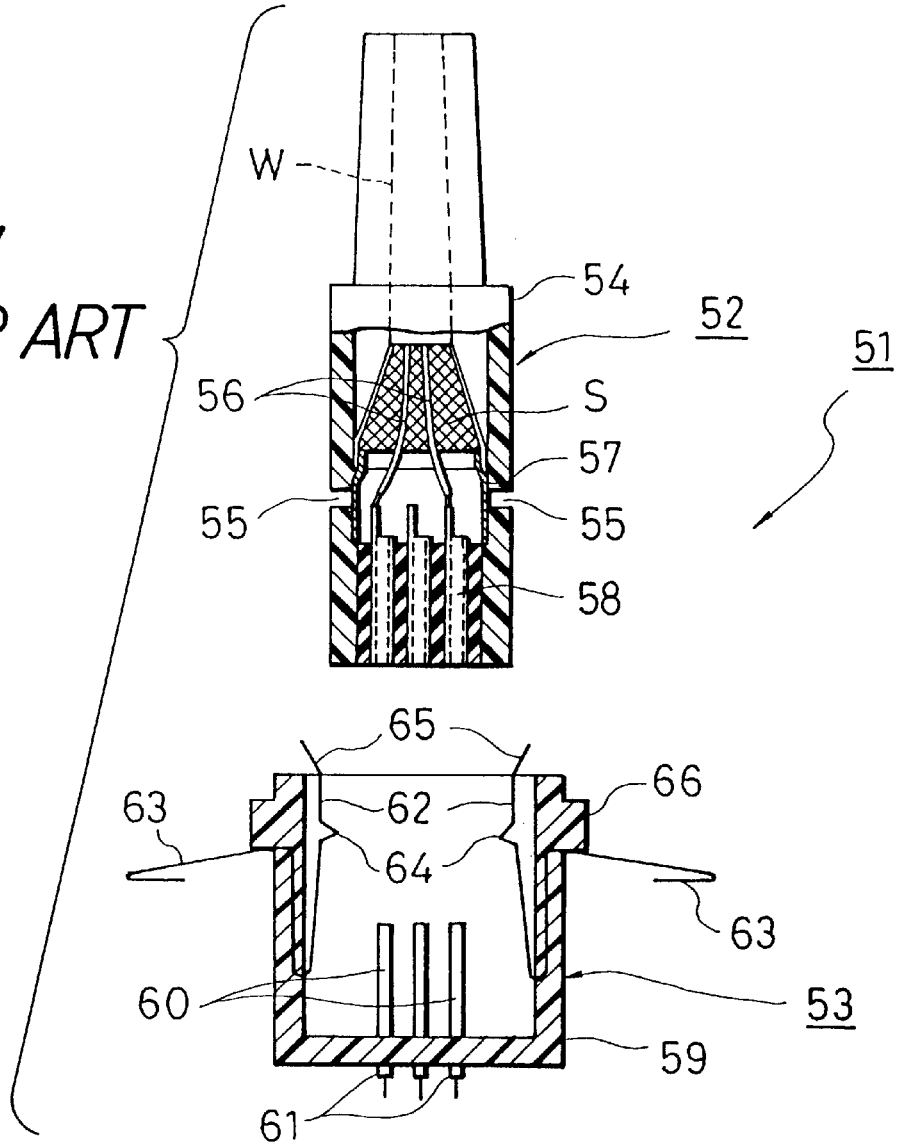
FIG. 7 PRIOR ART
FIG. 7 is a longitudinal sectional view showing an example of a conventional shielding-member-containing connector assembly.
Figure 8:
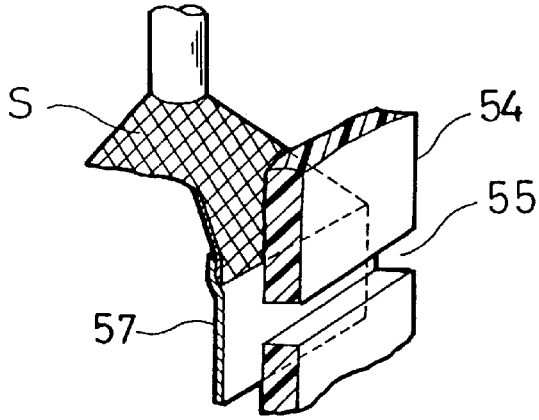
FIG. 8 PRIOR ART
FIG. 8 is a partly perspective view showing a main part of the conventional connector assembly depicted in FIG. 7.

As shown in FIG. 6C, the shielding braid connection member 6 is then inserted into the male housing 8 from the rear till the shielding braid connection member 6 abuts against the front end flange portion of the male housing 8. Finally, as shown in FIG. 2, the rear cap 25 is locked in the lock hole 26 by the lock protrusions 24 at the rear end of the slide member 11.

Incidentally, parts inserted from the rear of the male terminal 7 to be assembled are necessary to be made to pass on the shielded electric wire W in advance before the shielded electric wire W is clamped by the male terminal.

Figure 4:
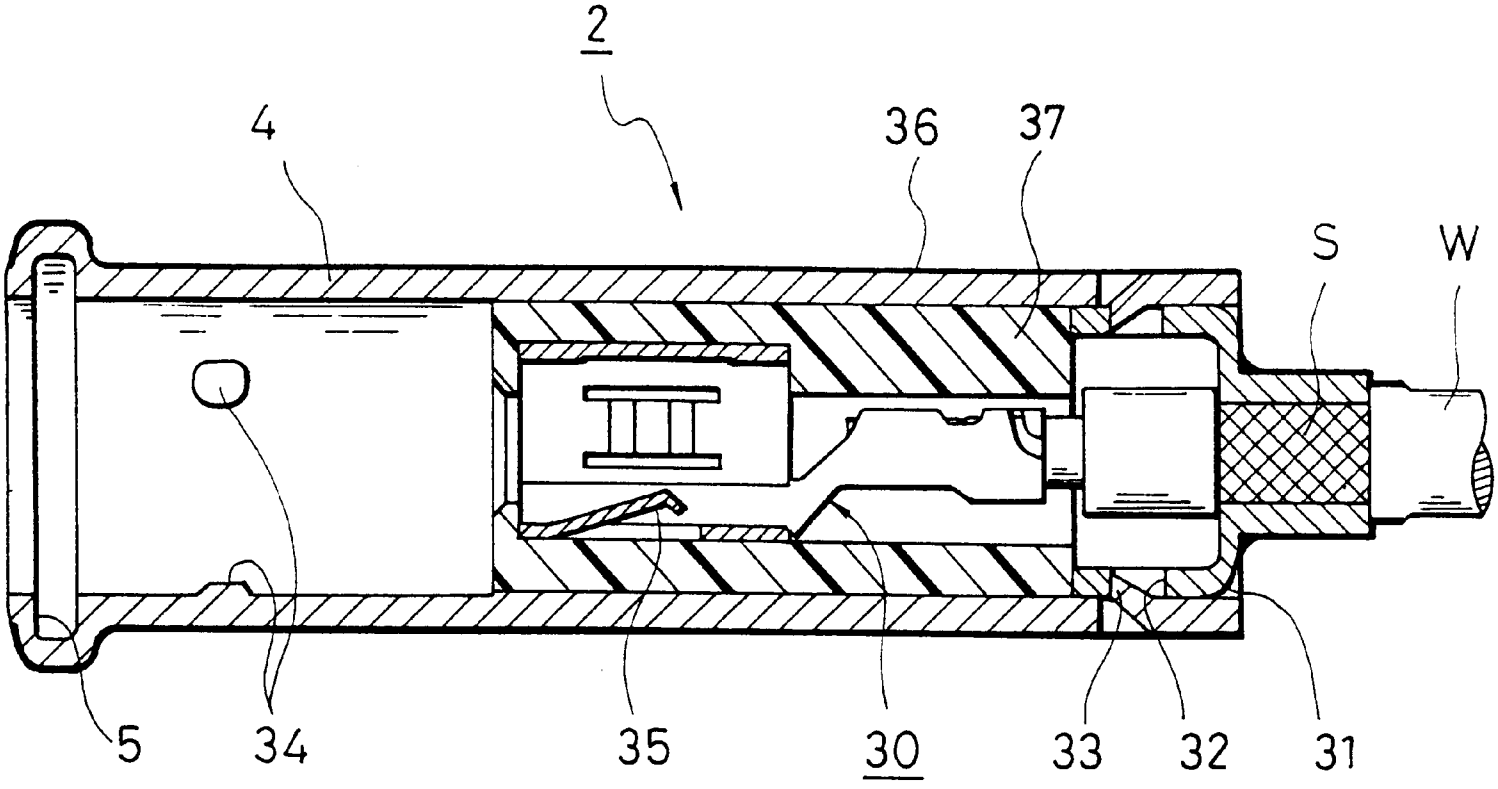
FIG. 4 is a longitudinal sectional view of the female connector depicted in FIG. 1.

On the other hand, as shown in FIG. 4, the female connector 2 includes a female housing 37 accommodating the female terminal 30 to which the shielded electric wire W is electrically connected, and the metal shell 4 having substantially a hollow cylindrical shape. A groove portion 5 is formed in the inside of the metal shell 4. The metal shell 4 is shield-connected to the shielding braids S of the shielded electric wire W through a shielding braid connection member 31. Further, a plurality of guide protrusions 34 are provided on the inner wall of the front end portion of the metal shell 4 to guide the slide member 11 of the male connector 3. Furthermore, an inward and obliquely forward lance 33 is provided on the inner wall of the rear end portion of the metal shell 4 to lock a lock hole 32 of the shielding braid connection member 31 shield-connected to the shielding braids S of the female connector 2 side shielded electric wire W.

Further, a spring contact 35 is provided in a contact housing of the female terminal 30 so as to be electrically connected to the plug terminal 21 of the male terminal 7. Further, the outer circumference of the female connector 2 is covered with a shrinkable tube 36 formed of an electrically nonconductive material.

In the shielding-member-containing connector assembly 1 configured as described above according to the embodiment of the present invention, the female and male connectors 2 and 3 are connected and fitted to each other easily as shown in FIGS. 1 and 2 when the female and male connectors 2 and 3 are pressed against each other while forward ends thereof are aligned. In this occasion, the female and male terminals 30 and 7 are electrically connected to each other through the spring contact 35, and also the outside of the female and male terminals 30 and 7 is covered with parts shield-connected to the shielding braids S on the female and male sides respectively. That is, the male-side shielding braids S, the shielding braid connection member 6, the resilient piece 14, the contact 15, the metal shell 4, the lance 33, the lock hole 32, the shielding braid connection member 31 and the female-side shielding braids S are electrically shield-connected in the order.

Further, since the engagement protrusions 10 pressed outwardly by the resilient pieces 9 are engaged with the groove portion 5, the female and male connectors 2 and 3 are fitted and connected to each other securely so that the connector assembly 1 is excellent in handling characteristic and reliability.

Figure 5:
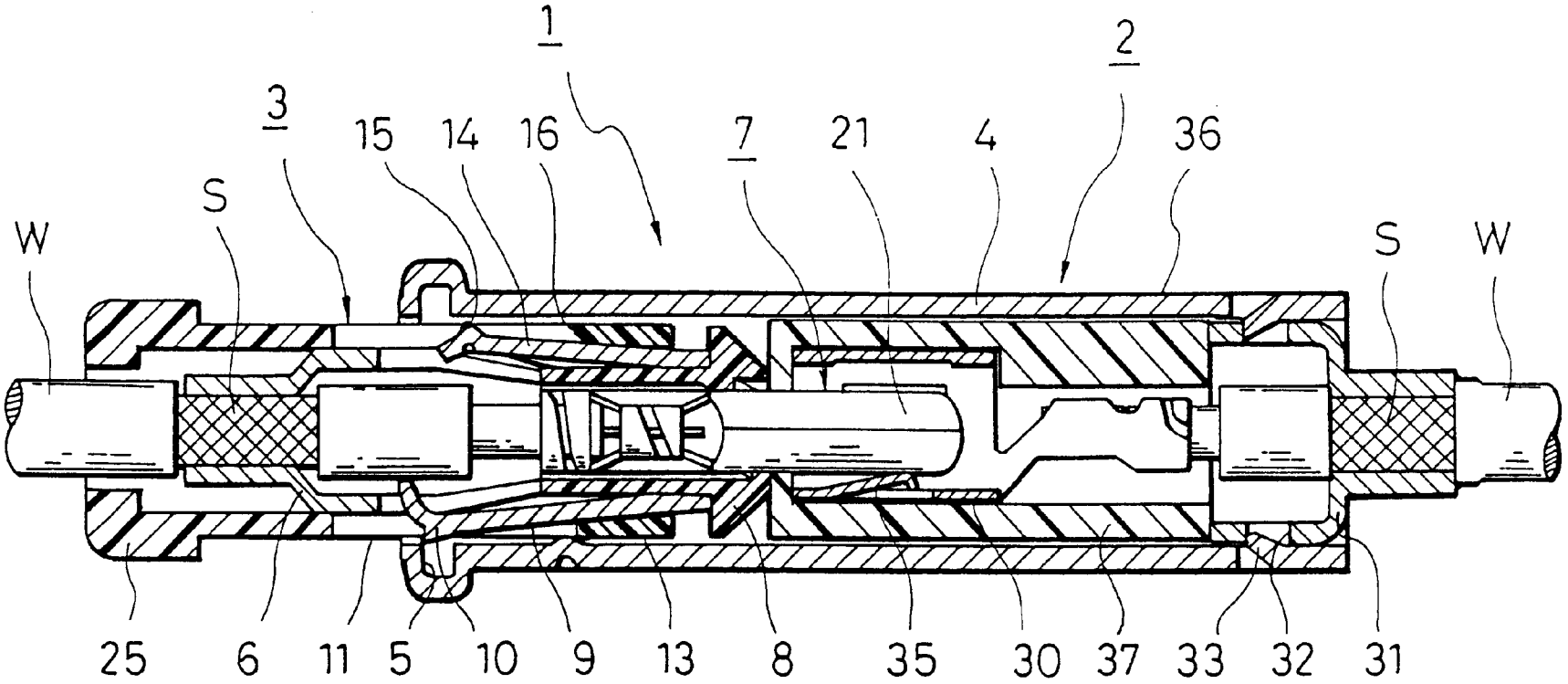
FIG. 5 is an operational explanatory view showing disconnection of the connectors depicted in FIG. 1.

When the connected female and male connectors 2 and 3 are to be disconnected from each other, the following operation is made. When the metal shell 4 of the female connector 2 covered with the shrinkable tube 36 and one of the slide member 11 and rear cap 25 of the male connector 3 are pulled apart from each other while the metal shell 4 and one of the slide member 11 and rear cap 25 are held by the fingers, the slide member 11 is first slid in the connector disconnecting direction so that the resilient pieces 9 and 14 are axially narrowed by the pressing wall 13 as shown in FIG. 5. Accordingly, the engagement protrusions 10 are made to depart from the groove portion 5, so that the contact 15 is separated from the inner surface of the metal shell 4.

When the slide member 11 is further pulled in the connector disconnecting direction, the step portion 20 shown in FIG. 2 abuts against the lance 18 of the shielding braid connection member 6 so that the shielding braid connection member 6 is also pulled in the connector disconnecting direction. Accordingly, since the lance 17 abuts against the step portion 19 of the male housing 8 and, at the same time, the step portion 23 shown in FIG. 3 abuts against the lance 22 of the plug terminal 21, the male terminal 7 shown in FIG. 5 is disconnected from the female terminal 30.

As described above, when the metal shell 4 which is an outer shell of the female and male connectors 2 and 3 and the shielding braid connection member 6 are merely pulled apart from each other in the connector disconnecting direction, the connection state of the female and male connectors can be canceled. Accordingly, efficiency in maintenance can be improved.

Incidentally, it is a matter of course that the present invention is not limited to the aforementioned embodiment but the present invention can be carried out by another embodiment if suitable changes are made. Although the aforementioned embodiment has been described about the case where the resilient piece 9 having the engagement protrusion 10 and the resilient piece 14 having the contact 15 are provided so as to be opposite to each other in one and the same section as shown in FIG. 1, it is a matter of course that a pair of resilient pieces 9 each having a engagement protrusion 10 may be provided so as to be opposite to each other in one and the same section and that an resilient piece 14 having a contact 15 may be provided in another position.

What is claimed is:

1. A connector assembly, comprising:

a first connector, comprising:

a first housing including a first terminal to which a first shielded electric wire is electrically connected, and a metal shell including a hollow portion secured to the first housing, the hollow portion having an annular groove portion formed in an inside surface thereof, the metal shell being connected to the first shielded electric wire; and a second connector comprising:

a second housing including a second terminal to which a second shielded electric wire is electrically connected, a second shielding member connected to the second shielded electric wire, the second shielding member including a plurality of resilient pieces which have at least one engagement protrusion, and a slide member provided on an outer circumference of the second shielding member and slidable with respect to said second housing, the slide member including a notch portion formed so that the at least one engagement protrusion of the second shielding member is projectable therethrough, and a pressing wall which presses the resilient pieces toward the longitudinal axis of said second shielding member, wherein when the first connector and the second connector are fitted to each other, the at least one engagement protrusion is engaged with the groove portion.

2. The connector assembly of claim 1, further comprising a shrinkable tube formed of an electrically nonconductive material, the shrinkable tube covering an outer circumference of the first connector.

3. The connector assembly of claim 2, wherein the shrinkable tube covers an outer circumference of the metal shell.

4. The connector assembly of claim 1, wherein the metal shell has a hollow cylindrical shape.

5. The connector assembly of claim 1, wherein the first connector further comprises a first shielding member, and wherein the metal shell is shield-connected to the first shielded electric wire through the first shielding member.

6. The connector assembly of claim 1, wherein when the first connector and the second connector are fitted to each other, at least one of the resilient pieces is electrically contacted with the metal shell.

7. The connector assembly of claim 1, wherein the first shielded electric wire and the second shielded electric wire each has a core wire which is sheathed and a shielding braids for shielding the core wire.

8. The connector assembly of claim 7, wherein when the first connector and the second connector are fitted to each other, the core wire of the first shielded electric wire and the core wire of the second shielded electric wire are electrically connected with each other, and the shielding braids of the first shielded electric wire and the shielding braids of the second shielded electric wire are electrically connected with each other.

9. The connector assembly of claim 1, wherein the first housing is received in the metal shell.

10. The connector assembly of claim 1, wherein when the connected first and second connectors are to be disconnected from each other, the slide member is slid so that the resilient pieces are axially narrowed by the pressing wall.

11. The connector assembly of claim 10, wherein when the connected first and second connectors are to be disconnected from each other, the resilient pieces are axially narrowed by the pressing wall so that the engagement protrusion is disengaged from the groove portion.

* * * * *